US009797035B2

(12) United States Patent
Pahl

(10) Patent No.: US 9,797,035 B2
(45) Date of Patent: Oct. 24, 2017

(54) APPARATUS FOR APPLYING A HOT-MELT ADHESIVE TO A SUBSTRATE

(71) Applicant: Illinois Tool Works Inc., Glenview, IL (US)

(72) Inventor: Andreas Pahl, Erkrath (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 173 days.

(21) Appl. No.: 14/689,236

(22) Filed: Apr. 17, 2015

(65) Prior Publication Data

US 2015/0337426 A1 Nov. 26, 2015

(30) Foreign Application Priority Data

May 22, 2014 (DE) ..... 10 2014 007 425

(51) Int. Cl.
*B05C 11/11* (2006.01)
*C23C 2/00* (2006.01)
(Continued)

(52) U.S. Cl.
CPC ..... *C23C 2/003* (2013.01); *B05B 15/045* (2013.01); *B05B 15/0462* (2013.01); *B05B 17/04* (2013.01); *B05C 5/00* (2013.01); *B05C 5/0212* (2013.01); *C23C 2/04* (2013.01); *B05B 7/00* (2013.01); *B05C 5/027* (2013.01);
(Continued)

(58) Field of Classification Search
USPC ..... 118/301, 325, 401, 410, 416, 504, 505, 118/62, 63
See application file for complete search history.

(56) References Cited

U.S. PATENT DOCUMENTS 4,911,948 A 3/1990 McIntyre
5,360,516 A 11/1994 Cutright et al.
(Continued)

FOREIGN PATENT DOCUMENTS

DE 19854634 C1 2/2000
EP 0675183 A1 3/1994
EP 1429029 A2 6/2004

OTHER PUBLICATIONS

English Translation of DE-19854634, Feb. 24, 2000.*
International Search Report for PCT/US2015/031988 dated Sep. 3, 2015.

*Primary Examiner* — Yewebdar Tadesse
(74) *Attorney, Agent, or Firm* — Levenfeld Pearlstein, LLC

(57) ABSTRACT

The invention relates to applying a liquid to pasty hot-melt adhesive to a substrate (44), comprising a template (29), having at least one cavity (38) for the hot-melt adhesive, and also comprising an adhesive-transfer infeed (33), which is assigned to the template (29) and through which the adhesive can be introduced into the cavity (38). The special feature consists in that the apparatus (10) further comprises a transporting-fluid-supply opening (35), assigned to the template (29), and a device for displacing (13, 15), in particular pivoting, the template (29) between a first position, in which the cavity (38) is assigned to the adhesive-transfer infeed (33), and a second position, in which the cavity (38) is assigned to the transporting-fluid-supply opening (35), and therefore the adhesive, in the second position, can be discharged from the cavity (38) by a transporting fluid flowing through the transporting-fluid-supply opening (35).

16 Claims, 7 Drawing Sheets

(51) Int. Cl.

| | |
|---|---|
| ***C23C 2/04*** | (2006.01) |
| ***B05B 15/04*** | (2006.01) |
| ***B05C 5/00*** | (2006.01) |
| ***B05B 17/04*** | (2006.01) |
| ***B05C 5/02*** | (2006.01) |
| *B05D 5/06* | (2006.01) |
| *B05D 1/26* | (2006.01) |
| *B05D 1/32* | (2006.01) |
| *B05B 7/00* | (2006.01) |

(52) U.S. Cl.
CPC ..... *B05D 1/26* (2013.01); *B05D 1/32* (2013.01); *B05D 5/06* (2013.01)

(56) References Cited

U.S. PATENT DOCUMENTS

| | | | | |
|---|---|---|---|---|
| 5,569,348 | A | 10/1996 | Hefele | |
| 6,688,498 | B1 | 2/2004 | McGuffey | |
| 2006/0027683 | A1 | 2/2006 | Puffe | |
| 2010/0064967 | A1* | 3/2010 | Luebbecke | B05C 5/0233 118/300 |

* cited by examiner

APPARATUS FOR APPLYING A HOT-MELT ADHESIVE TO A SUBSTRATE

BACKGROUND

Apparatuses for applying a hot-melt adhesive, a so-called hot melt, to a substrate, in particular to a so-called disposable hygiene product, such as diapers or sanitary napkins, are already basically common knowledge from the prior art.

Particularly advantageous apparatuses have been developed, for example, as disclosed in commonly owned EP 1 429 029 A2, which discloses a corresponding apparatus in which use is made of so-called volumetric gear pumps in order to provide for precise metering of the quantity of molten adhesive which is to be dispensed. The adhesive actually exits from the dispensing nozzle (for example a slot nozzle) here on account of the prevailing pressure of the adhesive, for example once a delivery valve has been opened. In some cases, the exiting adhesive is also supplied heated modulation air, which is intended to delimit the exiting adhesive with shaping action, if appropriate it is subjected to turbulence or the like, en route to the substrate located beneath. The exit from the nozzle here always takes place on account of the prevailing adhesive pressure.

Even though such apparatuses operate optimally basically in most application cases, there are application cases in which in particular more complex application patterns of the hot-melt adhesive are desired.

Further known application systems apply a pattern using rotating cylindrical screens (rotary screen systems), in which the adhesive is dispensed onto the substrate from a stationary dispensing nozzle in the interior of the rotating cylinder, through the surface bearing a punched pattern. It is typically the case here that the substrate is brought into contact with the outer cylinder surface. The adhesive pressure here can prevail in particular permanently on the nozzle and, depending on the position of the cylinder surface, is alternately prevented from exiting and allowed to pass through, and therefore a pattern is produced on the contacting substrate. Pianalto, U.S. Pat. No. 4,911,948 discloses an example of an apparatus in which a regulated air pressure prevails on the adhesive store. In practice, however, such apparatuses have problems where the application pattern is concerned, in particular smearing.

Finally, there are also application systems in which application rollers which have, on their surface, either hollows or protuberances for retaining the adhesive are brought into contact with a substrate during their rotation. A corresponding apparatus is disclosed in EP 0 675 183 A1, wherein the rubber-coated heating roller has rubber protuberances on which a hot-melt-adhesive powder, that is to say not an adhesive which is already in a molten state, is deposited and dispensed under pressure, via the protuberances, onto the substrate. It is considered to be problematic in the case of such apparatuses, that such apparatuses are very complex and costly to produce. In addition, such systems usually do not achieve application speeds desired in particular for use with hygiene articles.

It is therefore an object of the present invention to provide an apparatus which is intended for applying hot-melt adhesives and allows for precise and reliable application along with optimal utilization of the adhesive used.

SUMMARY

The invention achieves this object by way of an apparatus comprising a template, having at least one cavity for the hot-melt adhesive, and also comprising an adhesive-transfer infeed, which is assigned to the template and through which the adhesive can be introduced into the cavity, wherein the apparatus further comprises a transporting-fluid-supply opening, assigned to the template, and a device for displacing, in particular pivoting, the template between a first position, in which the cavity is assigned to the adhesive-transfer infeed, and a second position, in which the cavity is assigned to the transporting-fluid-supply opening, and therefore the adhesive, in the second position, can be discharged from the cavity by a transporting fluid flowing through the transporting-fluid-supply opening.

In an embodiment, rather than discharging the hot-melt adhesive (also abbreviated to "adhesive" hereinbelow) under continuously prevailing adhesive pressure (for example on account of volumetric pumps), is thus essentially that of separating in the first instance a small sub-quantity of adhesive from the adhesive infeed, subsequently displacing the sub-quantity and then discharging it from the apparatus (at a separate location) by a transporting fluid, in particular compressed air, and applying it to the substrate.

The adhesive which is to be discharged is separated off here by being separated from the prevailing pressure of the adhesive flowing on behind, and the separate transporting fluid ensures optimized application to the substrate.

The adhesive is transferred to the cavity of the template, or supplied to the same, via an adhesive-transfer infeed. It is possible here for the adhesive-transfer infeed to be connected, for example via channels in the apparatus, to an adhesive connection which, for its part, is connected to an adhesive store which is separate or integrated in the apparatus.

In the adhesive store, the hot-melt adhesive is preferably melted and directed onward, via the channels, to the adhesive-transfer infeed. These channels are usually heated. It is also possible for the adhesive-transfer infeed to be heated.

Once it has entered into the template, the at any rate partially liquefied adhesive is displaced, by a drive acting on the template, to a transporting-fluid-supply opening. When it reaches the transporting-fluid-supply opening, the chamber has its contents preferably blown out by the transporting fluid, in particular compressed air. For this purpose, it is possible to provide, in the region of the transporting-fluid-supply opening, a so-called air knife, which provides a very sharp formation of air for discharging the adhesive from the cavity. This generates a blade of air which guides the adhesive out of the cavity (preferably through an exit opening of the apparatus) directly to the substrate.

It should preferably be ensured here that the gap between the template (or possibly a separate exit opening of the apparatus) and the substrate located beneath is minimized, so that the shape of the cavity is reproduced as precisely as possible on the substrate by the adhesive applied. A precise reproduction of the geometric shape of the cavity (or of the arrangement of a plurality of cavities) is also assisted here by a blade of air which is as sharp as possible. Non-contact application to the substrate, that is to say without any contact taking place between the apparatus or exit opening and substrate, is advantageous here.

The apparatus according to the invention makes it possible, in a novel manner, for adhesive to be applied to a substrate in a very sharply defined and optimized manner. It is preferably ensured here that the cavity must/may accommodate only a relatively small quantity of the adhesive, preferably only a few drops of the adhesive. The cavity therefore has very small/narrow dimensions, only a cavity of relatively small/narrow dimensions also being capable of retaining during displacement (by the displacement device) the adhesive introduced into it. If the cavity were to have very generous dimensions, for example dimensioning of one centimeter times one centimeter, then, possibly on account of surface tensions being too low, the adhesive, when directed into a cavity of such large dimensions, rather than remaining in the cavity, would leave the cavity again even prior to the same being displaced.

Rather, it is therefore advantageously the case that the cavity, at least along one of its two surface dimensions, has a width of less than two millimeters, preferably of less than one millimeter.

The cavity here, as seen in plan view, is in particular in the form of dots or in linear form.

Accordingly, cavity, within the context of the present patent application, is understood as being not exclusively a fully closed-off and separated, hollow-like space in a material. Rather, cavity describes, in particular, a through-passage in the template. To this extent, the cavity is enclosed, for example, by lateral walls, but is open towards the top and bottom.

It is preferable for the template to have not just merely one cavity, but a multiplicity of cavities. This multiplicity of cavities may be arranged on the template in particular in the manner of a pattern. It is thus possible for there to be a first group of cavities which, together, form a first pattern in a raster-like manner (for example a rectangle which is formed from a multiplicity of dot cavities arranged in a rectangular shape). This pattern can then be arranged repeatedly on the template using further groups of cavities with a certain distance therebetween (however, it is also possible, as an alternative, for the pattern to be arranged on the template in varying form).

When adhesive is applied, the individual patterns of the template are guided one after the other past in the first instance the adhesive-transfer infeed and then the transporting-fluid-supply opening.

If the template is designed in the form of a rotary body which is made to rotate, or is pivoted, for displacement purposes, the individual patterns may be arranged in the manner of a circular ring, and therefore the pattern can be guided endlessly past the adhesive-transfer infeed and the transporting-fluid-supply opening. This makes it possible for application to be optimized in particular in the case of a substrate which is guided endlessly beneath the apparatus.

In an embodiment, the template is in particular pivoted by the displacement device. "Pivoting" here, for purposes of the present disclosure, in particular also covers rotation of the template and is understood in the form of a broadly encompassing term.

The template may be designed, in particular, in the geometrical form of a CD, having approximately the typical dimensions thereof. The cavities are then made through the surface of the CD-like body by etching, cutting operations or the like.

As already described, it is possible for a plurality of the cavities to make up a pattern which then continues in the same manner (or in varying form) over the template, preferably in the displacement direction of the template (that is to say in an annular manner in the case of rotation).

This means that, in addition to providing straightforward basic patterns (such as a rectangular arrangement of numerous cavities), more complex patterns are also made possible. It is thus possible for the adhesive to be applied to a baby's diaper for example in the form of motifs which are suitable for children (for example in the form of a teddy bear or of a teddy-bear head or also of a bird or the like). This may be desired, in the case of a diaper, for example for providing a so-called moisture or wetness indicator, in the case of which a, for example, transparent film, or some other transparent material layer, is also applied, in a later operating step, over the adhesive applied, and the adhesive changes color in dependence on the level of moisture of the substrate.

The rasterization of a pattern into various sub-dots can also give rise to the impression of continuous patterns, for example the impression of endless undulating lines or the like. It is indeed the case that the endless motifs are actually made possible by numerous separate cavities for the adhesive. However, in the application pattern, the dots of adhesive applied from the individual cavities then merge into one another visually or actually.

The preferably rotationally displaced template, according to the invention, can usually be activated by a drive (for example by a servomotor), which acts on the template typically via a drive shaft. The template here is incorporated in the apparatus such that it can be changed over without use being made of tools and/or auxiliary means. For example it is possible for an appropriate template to be designed in the manner of a CD and for the apparatus to provide a corresponding ejecting shaft or an ejecting drawer for the CD-like template. A user can store a plurality of templates with different cavity arrangements (pattern arrangements) and straightforwardly change over the templates manually by ejecting the template which has just been used and inserting a new one. As an alternative, it would also be possible to provide an apparatus for automatically changing over the template in the manner of a CD changer or the like.

In this context, the intention is to disclose, in particular, a system comprising an apparatus as claimed in claim 1 (or one of the following claims) and a second, alternative template, which can be changed over in a user-friendly manner in replacement of the first template, in particular with the aid of a tool-free opening mechanism of the apparatus. The opening mechanism here is provided such that the apparatus does not have to be specially dismantled. Rather, it is possible for the templates to be changed over without use being made of tools and/or auxiliary means.

The apparatus can be used to apply a so-called hot-melt adhesive to a substrate. The hot-melt adhesive is directed to the adhesive-transfer infeed when it is already in a liquid to pasty state. It is possible here for the adhesive to be kept in a tank or similar store when it is already in a liquid to pasty state or, as an alternative, also in a solid state (that is to say, for example, in the form of flakes). The critical factor is for the hot-melt adhesive to have reached a liquid to pasty state by being heated up prior to, or upon, reaching the adhesive-transfer infeed.

It is possible here for all the elements of the apparatus to be heatable in principle, that is to say, in particular, also the template, for example passively by way of the surrounding structural elements of the apparatus. The structural elements may have heating channels or the like or dispense a certain amount of heat to the template on account of their material properties.

The adhesive is discharged onto a substrate which, typically, is located directly beneath the apparatus. In this context, the apparatus is advanced as closely as possible up to the substrate, but does not make contact therewith.

A substrate is understood as being, in particular, an essentially sheet-like body which can be displaced preferably relative to the apparatus (or in particular relative to an exit opening). A substrate may be, in particular, a so-called endless material.

The apparatus can advantageously be used particularly in the field of so-called disposable hygiene products. These include, for example, diapers and sanitary napkins. During production thereof, in particular wing elements or closure elements are adhesively bonded to the basic substrate, for which purpose the basic substrate has to be wetted with adhesive. Another example is the already described wetness indicator.

A template, in practice, will have one or a multiplicity of cavities, it being possible for a first group of the multiplicity of cavities to form, for example, a first pattern and for a second group of a multiplicity of cavities then to form a second pattern, etc.

The apparatus presented makes it possible to dispense with extremely costly volumetric gear pumps which are known, in particular, in the prior art. It is usually sufficient for the adhesive to be supplied to the adhesive-transfer infeed in some other way. For example, normal piston pumps or similar pumping means can be used for this purpose.

This is because the dimensioning of the quantity applied is defined according to the present invention by the dimensioning of the cavities, and not by the dimensioning of a volumetric pump.

It should be noted, in addition, that the apparatus has, in principle, a control means which is in connection with the drive of the template and which is also connected to the drive mechanism of the substrate, and controls the same. This makes it possible for the drive speed of the template to be adapted to the drive speed of the substrate. For example, the speed of the template and substrate can be regulated such that the template executes a full revolution as precisely one substrate product which is to be wetted (for example a diaper or a sanitary napkin) is guided along beneath the template.

According to a particularly advantageous configuration, the apparatus has an exit opening which is assigned to the cavity when the template is located in the second position. In other words, the exit opening is assigned to the transporting-fluid-supply opening and is arranged in particular opposite the same (as seen in relation to the template).

In this way, the transporting fluid can drive the adhesive out of the cavity of the template and through the exit opening. In contrast to the template, the exit opening is of basically stationary design, i.e. it is at a fixed location and, in particular, at a fixed location relative to the substrate located beneath (at any rate if the latter is not being moved). The exit opening here is provided, in particular, by an outer termination plate or a nozzle plate of the apparatus, the plate usually covering the template. In this case, the exit opening is thus assigned to a separate component.

However, within the context of an embodiment, it is also conceivable in principle for the exit opening to be provided by the template or by a cavity outlet assigned to the substrate.

The exit opening of the apparatus here is advantageously adapted to the so-called air knife and the design thereof and is further advantageously arranged as closely as possible to the substrate, and even on the template.

A further advantageous configuration provides for the apparatus to have an adhesive-outflow channel, of which the inlet is assigned to the cavity when the template is located in the first position. In other words, the inlet of the adhesive-outflow channel is assigned to the adhesive-transfer infeed, and is arranged in particular opposite the same (as seen in relation to the template).

This configuration allows, on the one hand, an improved application pattern, but also, on the other hand, an optimized adhesive-supply circuit. It has thus been determined that the operation of filling the cavity with adhesive via the adhesive-transfer infeed is difficult if the initially empty cavity cannot have the air located there driven out of it.

The adhesive-outflow channel allows circulation or flow through the cavity when the cavity is being filled, and in particular allows the air located in the cavity to be discharged (this avoiding the situation where the adhesive displaced becomes mixed with the air).

The adhesive thus flows through the cavity during the filling operation and can be guided away from the template preferably on the other side of the template. It is particularly advantageous here for the adhesive-outflow channel to be designed in the form of an adhesive-return channel, in which case the unused adhesive can be guided back to the adhesive store, and an adhesive circuit is therefore formed. However, this is not imperative. For example, it is also possible for the adhesive-outflow channel to direct the adhesive out into a separate store, although the design in the form of an adhesive-return channel is considered, in principle, to be more advantageous. It is also possible for the adhesive-outflow channel to be heated.

The apparatus advantageously has a sealing wall, or a plurality of sealing walls, between the adhesive-transfer infeed (and possibly the inlet of the adhesive-outflow channel) and the transporting-fluid-supply opening (and possibly the exit opening). This ensures that the adhesive directed into the cavity remains in the cavity during (and upon) displacement of the template. For the case where the template is designed in the form of a disk, these walls would thus be arranged above and beneath the upper and lower surfaces of the disk. The structural elements which provide the walls here could also form the transporting-fluid-supply opening and the adhesive-transfer infeed (at any rate certain sections thereof).

These walls further advantageously consist of a sealing material which, in addition, has a particularly suitable coefficient of friction, since the walls, ideally, must not obstruct displacement of the template or, at most, must obstruct the same only to a very slight extent.

Accordingly, in an embodiment, the template is made to rotate by the displacement device. In this context, the template may be designed, for example, in the form of a disk, in particular in the manner of a CD, or for example also in the form of a cylinder tube. In both cases, the template can rotate about a central axis of rotation, and therefore a full revolution or rotation of the template results in the cavity or the cavities being guided precisely once past the adhesive-transfer infeed and/or past the transporting-fluid-supply opening. This allows, in particular, a very space-saving configuration of the apparatus, wherein, for the purpose of wetting a very long substrate, rather than having to use a very long template, it is sufficient to have a rotating template which, for a very long substrate, simply executes a plurality of revolutions per substrate through-passage.

Since the substrate is usually guided through linearly beneath the apparatus, a rotationally displaced template requires the arrangement of the cavities to be adapted in order to take account of the fact that the cavities are guided in rotation past the transporting-fluid-supply opening, while the substrate is moved linearly past the transporting-fluid-supply opening. This applies, in particular, to the template being designed in the form of a disk; less to the template being designed in the form of a cylinder tube.

In the first-mentioned case, it is possible to provide software which performs a conversion from an application pattern of the adhesive, as is intended to be subsequently produced on the wetted substrate, into a pattern as is introduced, by way of cavities, in the template designed, in particular, in the form of a disk. Such a conversion unit may be a constituent part of the apparatus, in particular of the control means of the apparatus.

In an embodiment, the template is designed in the form of a disk, the latter having in particular a diameter between 5 and 20 cm, more particularly between 7 and 14 cm, preferably of approximately 12 cm. This diameter here corresponds approximately to the diameter of a commercially available CD, as a result of which the template can be picked up in one hand and inserted into commercially available CD cases for storage purposes.

In the same way as a commercially available CD, it is also the case that the template, rather than being a closed disk, is advantageously of annular design. The template is further advantageously designed in the form of a round disk.

Cavities are introduced between the upper side of the template and the underside of the template, in order to allow specific application patterns of the adhesive on the substrate. The disk is preferably a stainless-steel disk, which is further advantageously subjected to laser cutting in order for the cavities to be introduced. As an alternative, however, it is also possible for the disk to be machined by means other than a laser cutter in order to form the template. For example, use can be made of etching techniques or water-jet cutters or the like.

A further advantage of the design of a disk with one of the aforementioned diameters is that, in the case of the cavities being arranged in the outer region of the disk, the cavities, during precisely one revolution of the disk, cover a distance which corresponds approximately to the application region of a diaper. If the intention is to wet a shorter product, for example a sanitary napkin, it is also possible for the openings or the patterns to be arranged more closely to the axis of rotation of the disk. As an alternative, for the purpose of wetting a shorter product, it is also possible to use a template which has a pattern progressing only over part of its circumference (for example only half or three quarters of the template has a pattern progressing over it). As a further alternative, for application to a shorter product, it is also possible for the speed of the template to be changed relative to the conveying speed of the substrate, in particular to be increased (account having to be taken, for the arrangement of the cavities in the template, of a corresponding application distortion).

The template further advantageously has a positioning marker. For calibration of the template or for first-time insertion, this positioning marker is intended to facilitate coordination with the substrate which is to be wetted. It is thus possible for the template to have patterns which necessarily provide a certain starting point (which are to be applied to a substrate first). The user can identify, from the positioning marker, the alignment in which the template is to be inserted into the apparatus or arranged on the apparatus.

The positioning marker may be, for example, a graphic marker, in the manner of a print, on the template or a physical marker, in the manner of a material cutout (notch) or an addition of material (material lug) or the like. The apparatus in this case is configured particularly advantageously if it has, in addition, a stationary counter-marker, which the user can use as a reference point for inserting or fitting the template. It is thus possible for the template to have, for example, a marker in the manner of an arrow and for the apparatus mount (e.g. a frame) for the template to have a second arrow, wherein the two arrows have to be aligned in relation to one another when the template is inserted. If the arrows are aligned with one another, then the user can assume that, when the apparatus is switched on, in the first instance the expected pattern will be applied to the substrate.

As an alternative to a graphic marker, however, it is also possible for an annular template to have, in the region of its central opening, a small lug or a notch which can be brought into form-fitting engagement with a counter-notch or counter-lug of the shaft driving it.

According to a further embodiment, the apparatus has an opening mechanism which allows the template used to be replaced by an alternative template without use being made of auxiliary means or tools. In particular for the case where the template is designed in the form of a disk, use can be made here of mechanisms which are known from CD players. For example it is possible for the apparatus to have an accommodating drawer for the template, the drawer being opened by the push of a button, or for the apparatus to have an introduction slot for the template. At any rate, the template can be installed or inserted even by a layman, there being no need for a person skilled in the art to dismantle the apparatus (in part at any rate).

The cavity provided in the template advantageously has a width of not more than two millimeters, preferably of not more than one millimeter. It is possible, in this context, for the cavity to be designed either essentially in the form of dots or else in linear form, the line then being of the maximum width mentioned (but being very much longer than two millimeters or one millimeter in the longitudinal direction).

In actual fact, a template usually has very many more than just one cavity. Rather, the template has patterns which are made up in each case of numerous cavities. Such patterns are introduced into the template in particular in a rasterized state, rather than over a continuous surface area.

The aforementioned, relatively narrow design of the cavities results in the adhesive remaining reliably in the cavity even when the template is being displaced between the adhesive-transfer infeed and the transporting-fluid-supply opening, and therefore it would not be imperative to provide sealing walls. The fact of the adhesive remaining in the cavity is also due, inter alia, to the surface tensions which occur, it being possible for the cavity width to be selected in dependence on the material property of the hot-melt adhesive used.

A method of applying a liquid to pasty hot-melt adhesive includes:

a) infeeding a hot-melt adhesive,
b) directing a quantity of hot-melt adhesive into a cavity of a template,
c) separating the quantity of hot-melt adhesive from the infeed by displacement of the template together with the cavity,
d) guiding the cavity past a transporting-fluid-supply opening and, in the process, discharging the adhesive from the cavity and the apparatus by a transporting fluid flowing through the transporting-fluid-supply opening, wherein
e) the adhesive discharged comes into contact with the, in particular moving, substrate.

The method uses in particular advantageously an apparatus as described above, and it should be noted here that all the advantages presented in respect of the above-described, disclosed apparatus can also be transferred analogously to the above-described, disclosed method, and vice-versa.

The drive of the template is advantageously activated in dependence on displacement of the substrate. This provides, in particular, advantages for switching on the apparatus. This is because conventional prior-art apparatuses involve a so-called "ramp effect", which ensures that the operation of applying adhesive, when the system is switched on/started up, can be adapted only to a certain extent to the start-up speed of the substrate located beneath.

The disadvantage here is that the substrate which is wetted during the start-up process of the system cannot be used industrially in its entirety and has to be disposed of. In particular for the case where the template, according to the method of the invention, is driven by a servomotor, however, the template and substrate, as presently disclosed, can be synchronized such that no ramp effect occurs. It is thus possible for the activation of substrate displacement to take place in dependence on the activation of the template, and therefore no ramp effect occurs and even that part of the substrate which is wetted first can be used industrially.

In particular it is possible for the control means of the template drive to be adapted to the substrate such that the individual cavities, when being displaced, have approximately a circumferential speed which corresponds to the linear speed of the substrate. However, if the pattern realized in the template is to be represented in a compressed state, the speed of the template can be increased. If, in contrast, the application pattern is to be equalized, the speed of the template can be reduced. Displacement of the template always takes place in dependence on displacement of the substrate. A joint apparatus control means may be provided for this purpose.

DESCRIPTION OF THE DRAWINGS

Further advantages of the present disclosure can be gathered with reference to the appended claims in their entirety and from the following description of the exemplary embodiments illustrated in the drawings, in which:

DETAILED DESCRIPTION

Ahead of the following description of the figures, it should be noted that, for the sake of simplicity, the same or comparable parts in comparable exemplary embodiments are provided with the same reference signs, in some cases with the addition of lower-case letters or of apostrophes.

Figure 1:
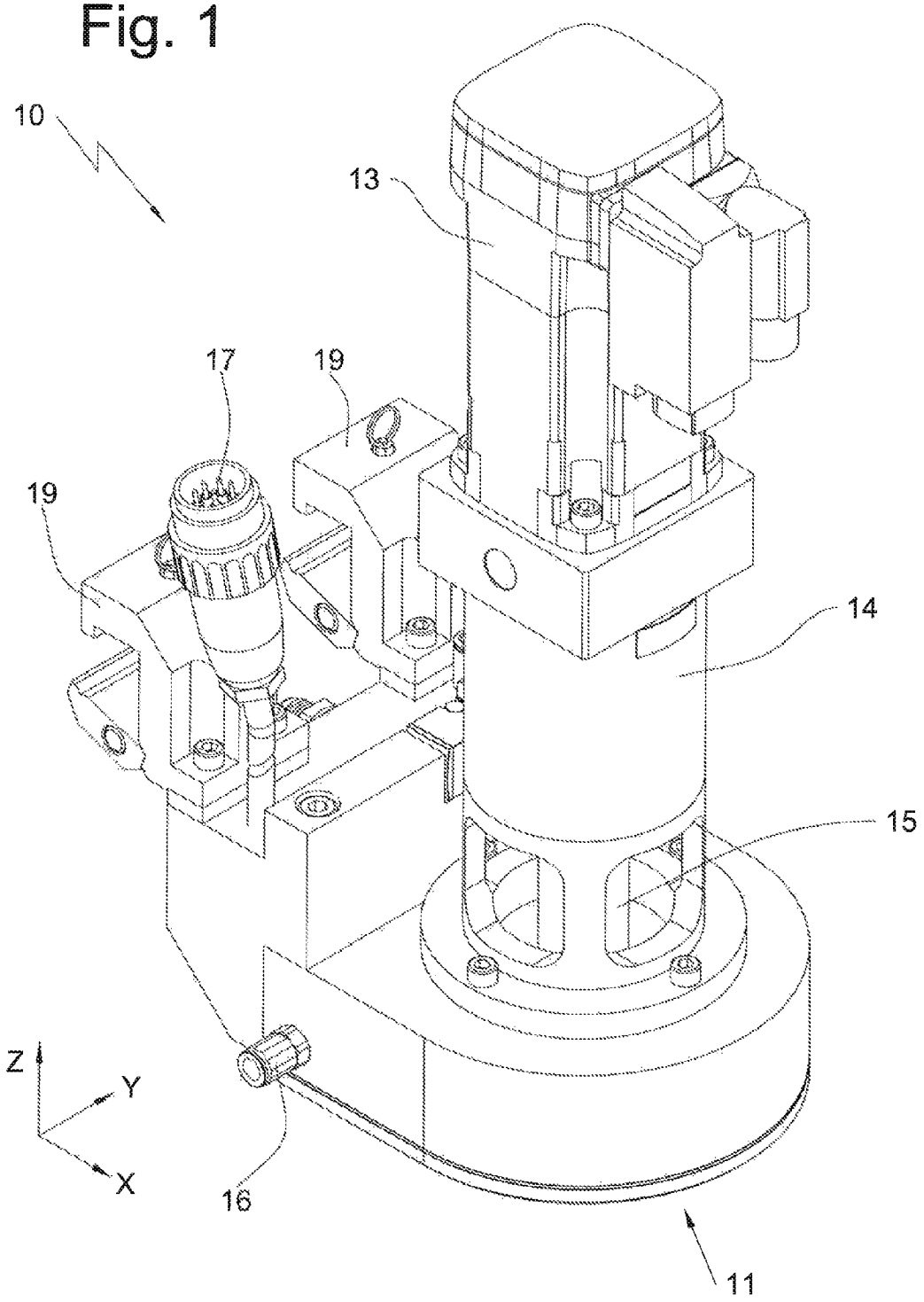
FIG. 1 shows, in a schematic, perspective obliquely illustrated plan view from the front, of an embodiment of the apparatus in a state in which it has not yet been connected to electricity and compressed air.
Figure 2:
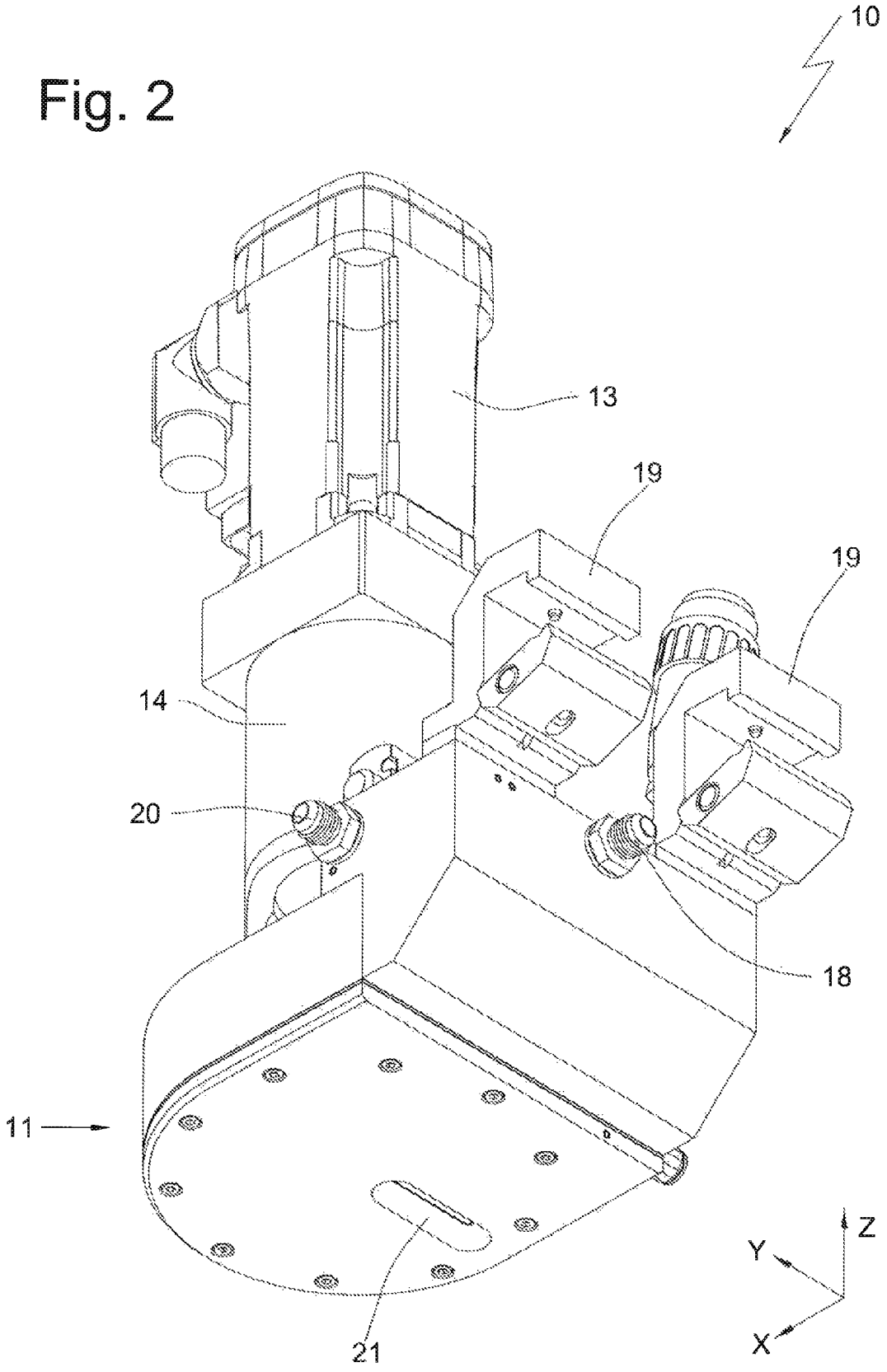
FIG. 2 shows, in a perspective/schematic obliquely illustrated bottom view from the rear side, the apparatus of FIG. 1, connected neither to an adhesive outflow nor to an adhesive infeed.
Figure 3:
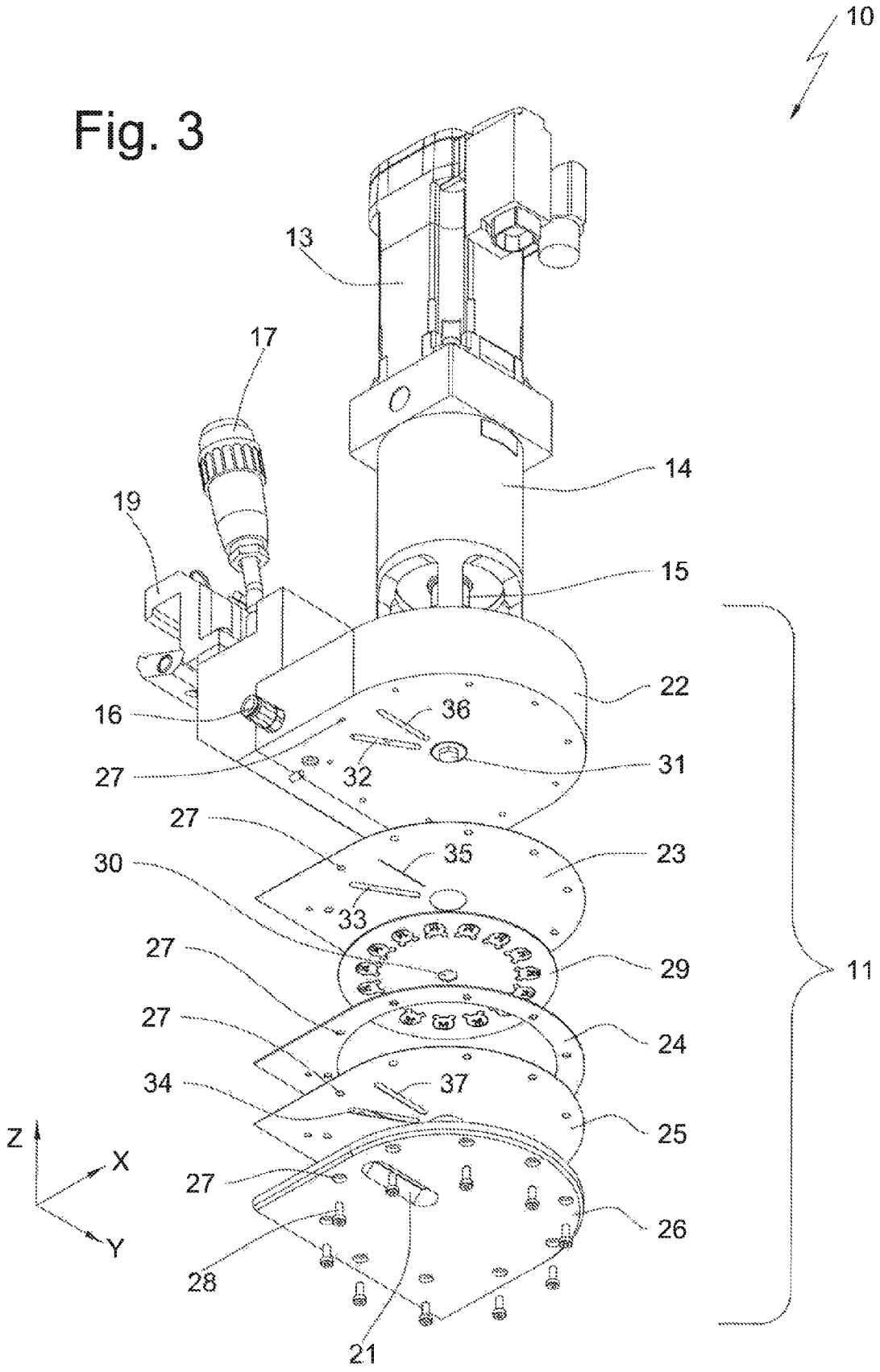
FIG. 3 shows, in a further perspective obliquely illustrated bottom view from the front side, the apparatus of FIG. 1 in a partially exploded state and with a first example of a template inserted.

A first exemplary embodiment of the apparatus is provided with the reference sign 10 in FIGS. 1 to 3.

FIG. 1 shows, in a perspective schematic obliquely illustrated plan view, in the first instance the basic construction of the apparatus 10. Thus, the apparatus has an application head 11, by means of which the apparatus 10 dispenses adhesive in pattern form onto a substrate, which is arranged beneath the apparatus 10, as seen in relation to FIG. 1, but is not illustrated in FIG. 1. The substrate would be arranged in the vertical direction z beneath the apparatus 10 illustrated in FIG. 1 and could be displaced, for example, linearly in a direction of guidance X.

A template, which will be described in more detail at a later stage in the text, can be introduced into the application head 11 according to FIG. 1, the template being concealed in FIG. 1 since it is arranged in the interior of the application head 11. This template is driven in rotation, in the plane defined by the conveying direction X and the transverse direction Y, by a servomotor 13. The servomotor 13 here acts on the template via a transmission 14 with a shaft 15, which may have, for example, a hexagonal cross section.

The apparatus of FIG. 1, in addition, has a transporting-fluid or compressed-air connection 16, through which a transporting fluid, for example compressed air, can be introduced into the application head 11 in order to discharge the adhesive from the template and the apparatus 10 and to transfer the adhesive onto the substrate. The transporting fluid may be, in particular, heated for this purpose, and an electrical connection 17 is therefore provided, it being possible for the electrical connection to be supplied with power in heating zones arranged in the apparatus 10, but not illustrated explicitly. These heating zones can be used both for heating the compressed air introduced through the connection 16 and for keeping the adhesive introduced into the apparatus 10 warm, and therefore liquid to pasty.

The adhesive is directed into the apparatus 10 via an adhesive connection 18 illustrated in FIG. 2. For this purpose, the connection 18 can have connected to it, for example, a separate hose, which connects the apparatus 10 to a hot-melt store. As an alternative, the connection 18 can also be used to mount the apparatus 10 rigidly (that is to say not via a hose) on an adhesive infeed. In addition, the rear side of the apparatus 10, the rear side being illustrated in FIG. 2, has fasteners 19 in the manner of retaining clamps.

The adhesive, which enters into the apparatus 10 via the connection 18, is directed first of all (in a manner which is not illustrated in FIGS. 1 and 2) into the application head 11, where it can be directed into the template. The adhesive here flows through the template and, in particular, cavities which have been introduced into the template. Displacement of the template thus gives rise, on the one hand, to fractions of adhesive which are displaced along with the template and, on the other hand, when the template is flushed out, in fractions of adhesive which are removed in a manner which will be explained at a later stage in the text. For this purpose, the adhesive, once it has flowed through the template (without being transported along by the template), enters, in particular, into an adhesive-outflow channel in the application head 11 and is then directed to an outflow connection or return connection 20. By means of the connection 20, the adhesive either is directed out of the system or, as an alternative, preferably, is introduced back into the adhesive circuit. For example it is possible for the return connection 20, for this purpose, likewise to be connected to the same store to which the connection 18 is connected.

The adhesive transported along by the template is then discharged from the apparatus 10, out of an exit opening 21 of the application head 11, the opening being illustrated in FIG. 2, at a different location, with the aid of the transporting fluid directed into the apparatus 10 via the connection 16 according to FIG. 1, and applied to the substrate located beneath.

In order to clarify the construction of the application head 11, FIG. 3 shows the application head 11 in an exploded state. As is clear from FIG. 3, the application head 11 comprises, from top to bottom, a base 22, a first seal 23, a frame 24 for the template, a second, lower seal 25 and a nozzle plate 26. As can be gathered from FIG. 3, all the structural elements of the application head 11 here have a multiplicity of assembly openings which are aligned in relation to one another and of which just in each case one assembly opening of each structural element is designated by 27 in FIG. 3. For assembly of the apparatus 10 or of the application head 11, pin-like retaining means 28, such as bolts or screws, can be plugged in a conventional manner through the openings 27.

During assembly here, a template 29 is introduced into the frame 24, that is to say beneath the first seal 23 and above the second seal 25. The template is of round design, in the form of a disk, and has approximately the diameter of a commercially available CD. It has a central engagement opening 30, which may be of, for example, hexagonal design and through which, during assembly, a head 31 of the shaft 15 is plugged in a form-fitting manner.

The template 29 consists, for example, of stainless steel and is provided with cavities which are arranged to form patterns (a plurality of identical patterns in the form of teddy-bear heads are evident in FIG. 3) and are introduced into the disk 29 in the manner of laser cutting.

Purely for the sake of completeness, it should be noted that the apparatus shown in FIGS. 1 to 3 is provided with a single template for the duration of use. It is therefore the case that FIGS. 1 to 3 do not show any means for changing over the template 29 without use being made of tools. In an embodiment, albeit one which is not illustrated in FIGS. 1 to 3, the apparatus 10 may be adapted such that the template 29 can be changed over in the manner of a CD player or CD changer, without use being made of tools. For this purpose, the application head 11 may provide, for example, an ejecting drawer or some other kind of (for example a slot-like) ejecting mechanism, as is also known from commercially available CD players.

The operation of the apparatus 10 illustrated in FIGS. 1 to 3 will now be described. It is thus possible for a hot-melt adhesive to be directed into the apparatus 10 via the adhesive connection 18 illustrated in FIG. 2. The adhesive is then transferred, or directed onward, within the base 22 of the application head 11, from a dispensing opening 32, which is illustrated in FIG. 3, to a transfer opening 33 in the first seal 23. For transportation from the adhesive connection 18 to the transfer opening 33, it is possible to provide pumps, such as piston pumps or the like, in particular upstream of the apparatus 10.

Beneath the transfer opening 33 in the first seal 23, the template 29, which is driven by the shaft 15 and has cavities which can be assigned to the transfer opening 33, rotates within the frame 24.

Accordingly, the adhesive can enter, from the transfer opening 33, into those cavities of the template 29 which are moving past the transfer opening 33. The cavities of the template 29 have in particular the adhesive which is exiting from the transfer opening 33 flowing through them and, once it has passed through the template 29 (at any rate at least in part), the adhesive passes into an outflow opening 34 in the second seal 25. From this outflow opening 34 in the second seal 25, the outflowing adhesive can then pass into an outflow channel within the nozzle plate 26 and, from there, be directed to the return connection or outflow connection 20 illustrated in FIG. 2.

When the template 29 is displaced, however, a sub-quantity of the adhesive flowing through the template 29 is carried along by the template 29, and therefore, rather than passing into the outflow opening 34 in the second seal 25, this sub-quantity remains in the template 29 during displacement of the latter. The adhesive here, once it has entered into the template 29 from the transfer opening 33, is displaced to a fluid opening 35 in the first seal 23.

Exiting through the fluid opening 35 is a transporting fluid, in particular compressed air, which is supplied to the fluid opening 35 via the connection 16, which is illustrated in FIG. 1, and a fluid-transfer opening 36, which is provided in the base 22 and is illustrated in FIG. 3. The fluid exits from the fluid opening 35 with a very sharp edge, the fluid opening 35 and the fluid-transfer opening 36 constituting part of a so-called air knife, which provides high-pressure air which exits discretely with very sharp edges. The geometry of the fluid opening 35 is therefore also very much narrower than the geometry of the fluid-transfer opening 36.

The very sharp-edged compressed air exiting from the fluid opening 35 of the first seal 23 then drives the adhesive out of the adhesive-filled cavities in the template 29 which are being guided past beneath the air. The compressed air, together with the adhesive, is removed from, or blown out of, the apparatus 10 from the template 29, via a dispensing opening 37 in the second seal 25 and the exit opening 21 in the nozzle plate 26, and transferred onto the substrate located beneath.

In respect of the exemplary embodiment of FIG. 3, it should be noted, in conclusion, that the first and second seals 23 and 25 particularly advantageously have coefficients of friction, in order to allow the disk 29 to be displaced within the application head 11 in as friction-free a manner as possible. At the same time, however, the seals 23 and 25 are capable of butting closely enough against the template 29 to be able to perform their sealing function to a sufficient extent.

Figure 4A:
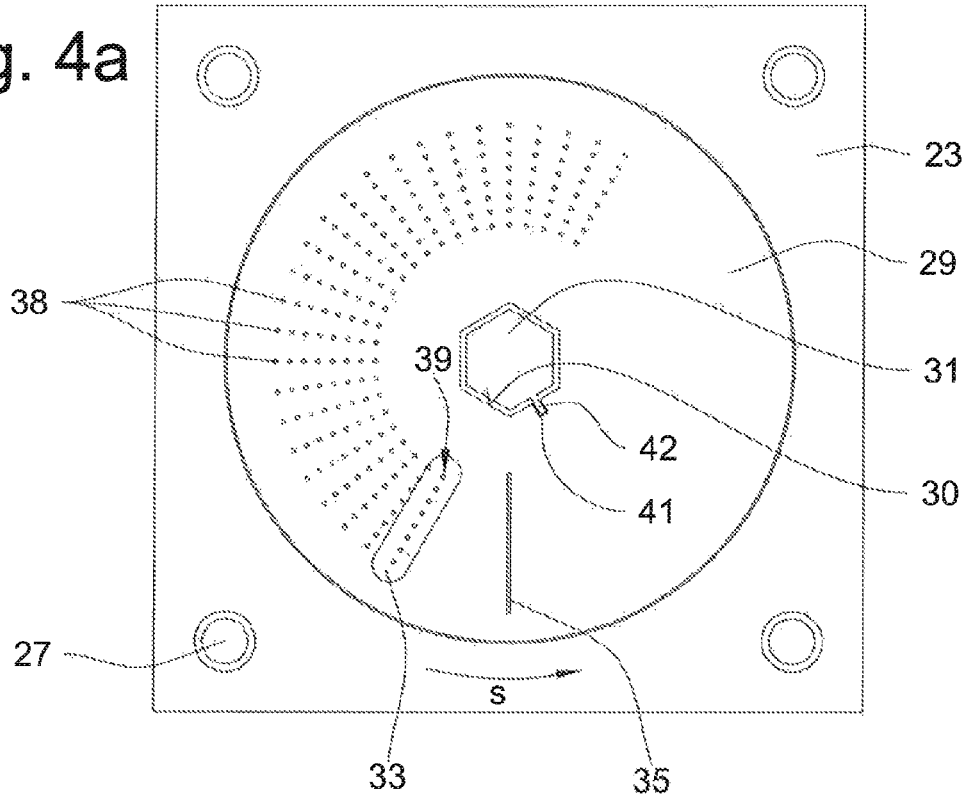
FIG. 4*a* shows a highly schematic, partially transparent section through the apparatus according of FIG. 3, for example along the seal which, in FIG. 3, is arranged above the template, the seal in FIG. 4*a* having a modified, essentially square shape, and the template according to FIG. 3, in addition, having been replaced by an alternative template with a different pattern.

FIG. 4*a* shows a section, in plan view, through the apparatus 10, the section being taken, in respect of FIG. 3, approximately level with the first seal 23 and being illustrated in a partly transparent form, in which the template 29 can also be seen.

The template 29 illustrated in FIG. 4*a*, however, is an alternative template to the template which is illustrated in FIG. 3, since the template 29 according to FIG. 4 has a different pattern. It is also the case that, for reasons of simplicity, the geometry of the first seal 23 has been simplified in the illustration to a square shape (whereas FIG. 3 illustrates a half-rounded seal 23), but, rather than adversely affecting the basic character of the seal, this is merely intended to simplify the illustration.

At any rate, FIG. 4*a* shows a template with cavities 38 which are arranged in a raster-like manner, for the sake of simplicity only some of these cavities being designated thus in FIG. 4*a*.

Figure 4B:
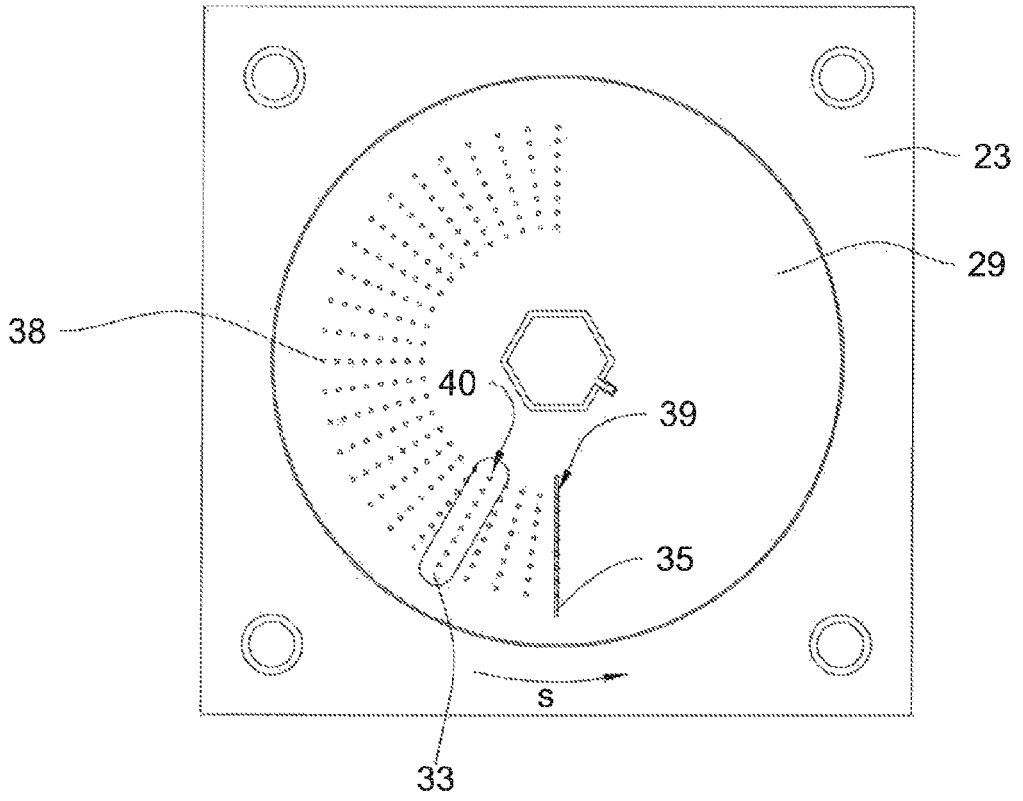
FIG. 4*b* shows, in a view according to FIG. 4*a*, the apparatus with a template pivoted slightly in the counter-clockwise direction.

According to FIG. 4*a*, the template 29 is located in a position in which eight cavities 38, which are arranged in a row 39, are arranged beneath the transfer opening 33 in the seal 23, as yet no cavity 38 being arranged beneath the fluid opening 35. The first row 39 of cavities is thus, according to FIG. 4*a*, just in the process of being filled with adhesive. The template 29 here, in respect of FIGS. 4*a* and 4*b*, is displaced in the pivoting direction S, that is to say is pivoted in a counterclockwise direction, by the shaft head 31 engaging in the engagement opening 30 of the template 29. During this displacement, the template 29 reaches the position which is illustrated in FIG. 4*b*, and in which the first row 39 of cavities 38 is now arranged beneath the fluid opening 35 of the first seal 23. In this position, the air knife can then blow out the contents of the first row 39 of cavities 38, via the fluid opening 35, in a downward direction as seen in relation to the plane of the figure, that is to say onto a substrate arranged beneath the plane of the figure, through the exit opening 21 (as is illustrated in FIG. 3). In a position according to FIG. 4*b*, the first row 39 is thus having its contents blown out, whereas the fifth row 40 of cavities 38 is in the process of being charged with adhesive, namely via the transfer opening 33.

The rows of cavities between the first row 39 and the fifth row 40 have been filled with adhesive; those rows of cavities which follow the fifth row 40 are still empty.

In an embodiment, a feature which is illustrated in FIGS. 4*a* and 4*b*, is a positioning marker 41 of the template 29, which is designed in the form of a physical notch. The shaft or the shaft head 31, in contrast, has arranged on it a positioning lug 42, which engages in the positioning notch 41. These positioning aids 41 and 42 are essentially not involved in driving the template 29; rather, they are used for correct initial positioning of the template 29 within the application head 11 (or within the frame 24). By virtue of these positioning aids 41 and 42 coinciding, the template can be positioned manually just in precisely one (aligned) position within the application head 11.

This ensures that, each time the apparatus 10 is switched on or started up, the template always has its pattern arranged correctly in relation to the transfer opening 33 and the fluid opening 35 and the exit opening 21.

Figure 5:
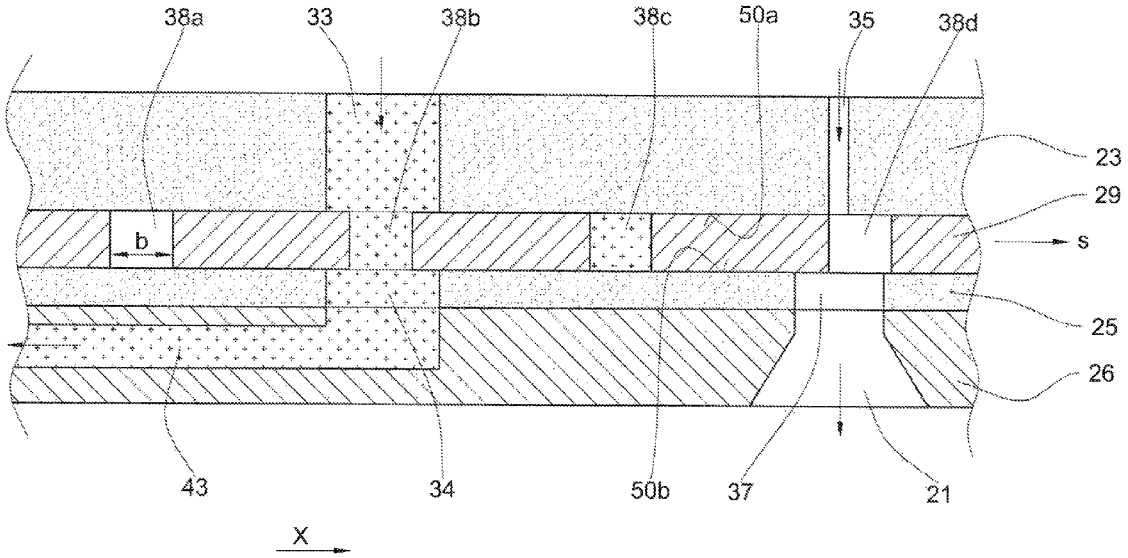
FIG. 5 shows, in a highly schematic, cut-away basic illustration, a lateral sectional view through the apparatus in the region of the template.

FIG. 5 is intended to clarify the filling operation of a template 29 and illustrates a highly schematic, lateral sectional view through a template 29 and through the first seal 23, the second seal 25 and the nozzle plate 26 (the material thicknesses of the components being illustrated in distorted form in FIG. 5 for reasons of clarity).

FIG. 5 illustrates a snapshot in which a first cavity 38*a* has not yet been filled with adhesive. A second cavity 38*b*, according to FIG. 5, is in the process of having adhesive flowing through it, the adhesive being directed into the cavity 38*b* via the transfer opening 33 in the first seal 23. On the underside of the cavity 38*b*, the adhesive flowing through can enter into the second seal 25, to be precise into the outflow opening 34. From the outflow opening 34, the adhesive then passes into an outflow channel 43 in the nozzle plate 26, via which it passes (via further channel portions which are not illustrated) to the outflow connection or return connection 20 according to FIG. 2.

FIG. 5 also shows a third cavity 38*c*, which has already been filled, but is not yet emptied. Finally, FIG. 5 illustrates a fourth cavity 38*d*, which has just been emptied by the air knife, using compressed air supplied via the fluid opening 35. Accordingly, the adhesive located in the cavity 38*d* has just been removed from the apparatus 10 via the dispensing opening 37 and via the exit opening 21.

It can also be seen in FIG. 5 that the exit opening 21, and in particular also the dispensing opening 37, are designed to be wider than the cavity 38*d*. This allows optimized discharge of the adhesive from the cavity 38*d*.

In respect of FIG. 5, it should be noted that the chambers in the present exemplary embodiment all have the same width b, which in the present exemplary embodiment is somewhat less than one millimeter, and it should be pointed out that the cross-sectional illustration of the disk 29 is distorted, since the individual cavities 38, on account of the rotary arrangement on the round disk, would not actually be located in a section plane. In sectional illustration, the cavities 38 have thus been projected into a common section plane, in order for the filling and emptying operations of the cavities to be explained purely schematically.

And, in respect of FIG. 5, reference is also made to the walls 50*a* of the upper seal 23 and 50*b* of the lower seal 25, the walls sealing the disk 29 and/or the cavities, in particular cavity 38*c*, arranged in this region. In an alternative embodiment, however, it is also possible to dispense with the walls 50*a* and 50*b*, in particular the lower wall 50*b*, if it is ensured that the adhesive remains in the cavity 38 on account of surface tensions or the like. In such an exemplary embodiment, the exit opening of the apparatus could then be provided by the underside of the cavity 38 itself.

Figure 6:
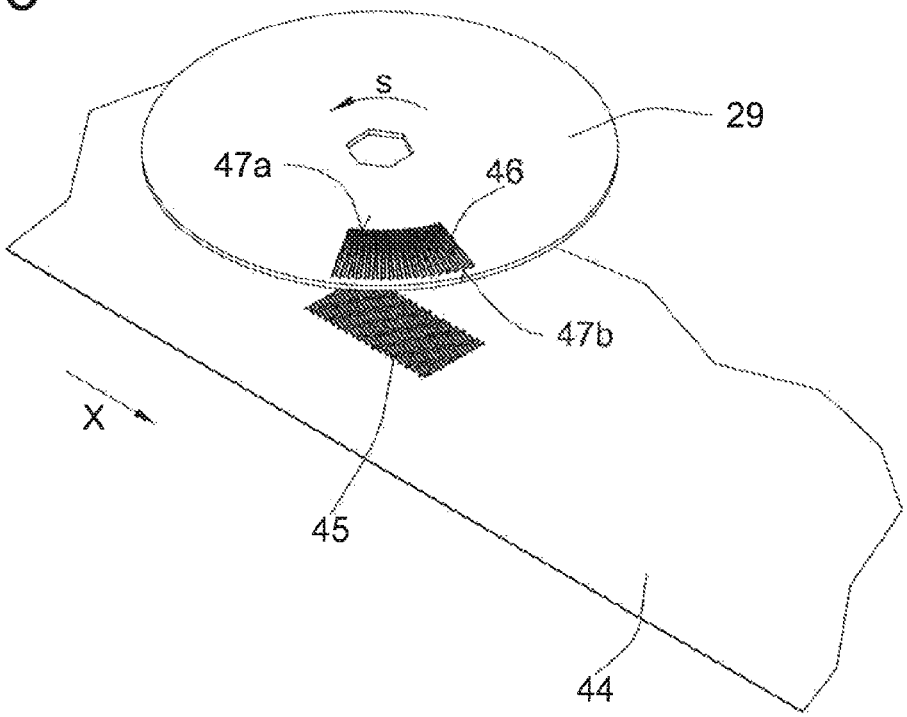
FIG. 6 shows a perspective, highly schematic basic obliquely illustrated plan view of a further alternative template, with adhesive applied to a substrate.

FIG. 6 shows, in a highly schematic illustration, a further exemplary embodiment of a template 29, with a bar-like application pattern 45 on the substrate 44. It is clear from FIG. 6 here that the application pattern 45, in terms of its geometrical shape, in the first instance clearly differs from the pattern 46 as is actually provided in the template 29. Whereas the application pattern 45 has its outer contour formed in the shape of a rectangle (and thus has right angles), this is not the case for the contour of the pattern 46 which is actually introduced into the template 29. Rather, the pattern 46 has curved outer contour lines 47*a* and 47*b*. The patterns 45 and 46 differ from one another as a result of the rotary displacement of the template 29 along the displacement direction S, which naturally differs from the linear displacement direction or conveying direction X of the substrate 44. Since the aim is for a desired application pattern 45 to be applied to the substrate, it has been found in practice to be advantageous to provide software which a user can use to predetermine their desired application pattern 45. The software, then, automatically calculates the shape of the actual pattern 46 on the template and can initiate appropriate cutting of cavities on a template blank.

It is also clear from FIG. 6 that large-surface-area application patterns, such as the application pattern 45 according to the present invention, are, in principle, rasterized. In other words, rather than a single large cavity being provided within the template 29, the template actually contains a multiplicity of small cavities 38 arranged, and distributed uniformly, within a desired contour.

Figure 7A:
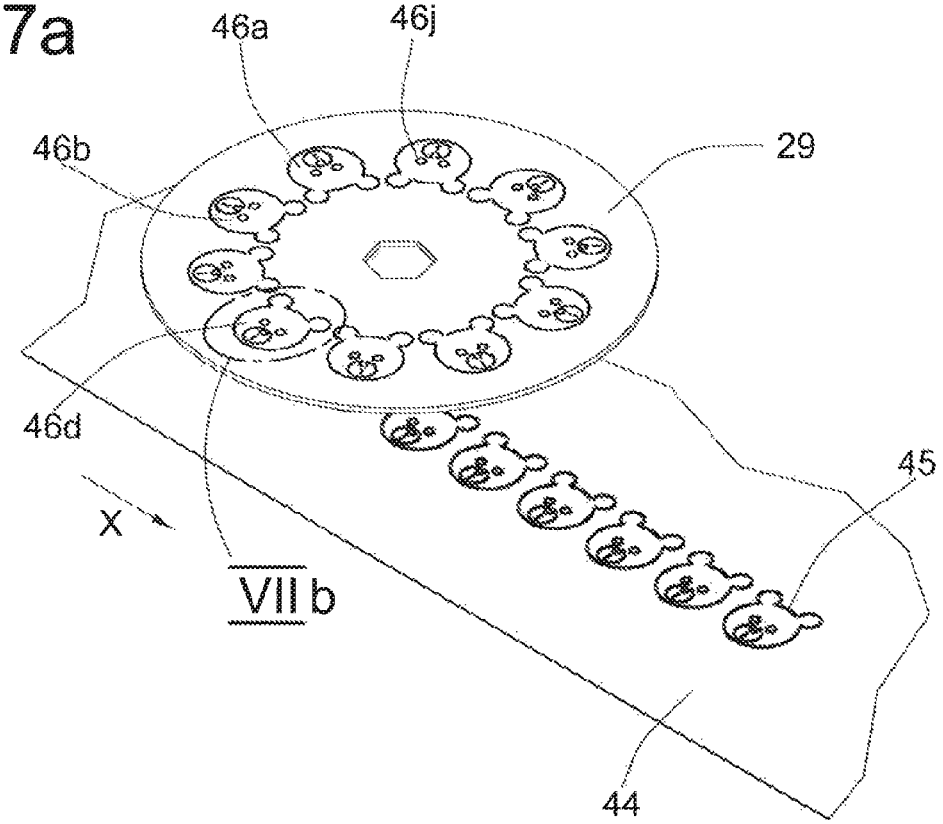
FIG. 7*a* shows, in a view similar to FIG. 6, the template of FIG. 3.

FIG. 7*a* shows, in a view according to FIG. 6, the template 29 as can already be seen in FIG. 3. The template has a plurality of patterns 46*a* to 46*j*, all of identical configuration. In an alternative embodiment, these patterns 46*a* to 46*j* could also be varied. It is clear from FIG. 7*a* here that the individual template patterns 46*a* to 46*j* are arranged in annular form in relation to one another, whereas the patterns, when actually applied to the substrate, are arranged in linear form, that is to say in a row.

Figure 7B:
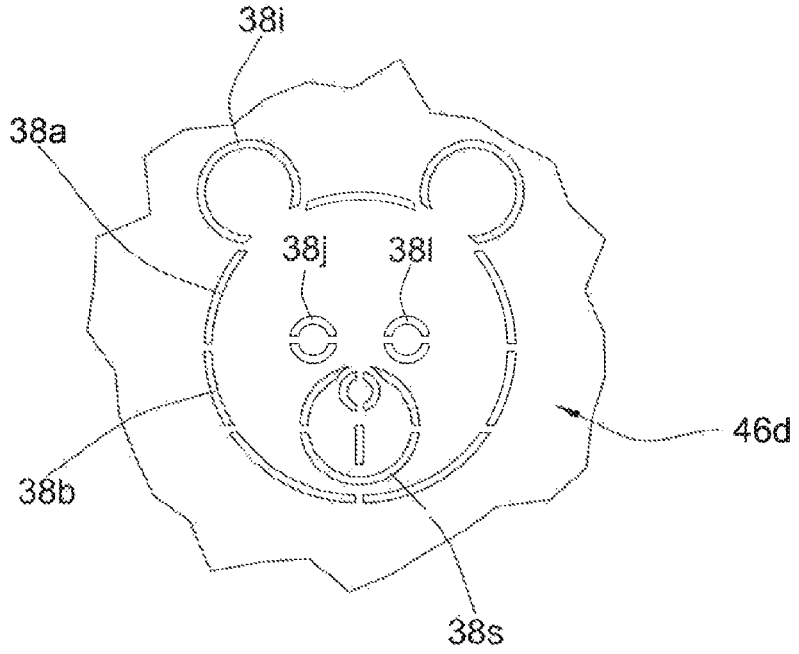
FIG. 7*b* shows a highly schematic, cut-away, enlarged plan view of a pattern from the template illustrated in FIG. 7*a*, the pattern being found approximately in the region VIIb of FIG. 7*a*.

FIG. 7*b* shows an enlarged illustration of the template pattern 46*d* in FIG. 7*a*. It is clear from FIG. 7*b* here that the pattern 46*d*, rather than being of continuous design, actually comprises numerous small cavities or sub-cavities 38*a* to 38*s*. To this extent, rasterization is also provided for such patterns, each of the cavities 38*a* to 38*s* having a width of less than one millimeter. To this extent, all the cavities 38*a* to 38*s* are of identical width, but vary in length.

Figure 8:
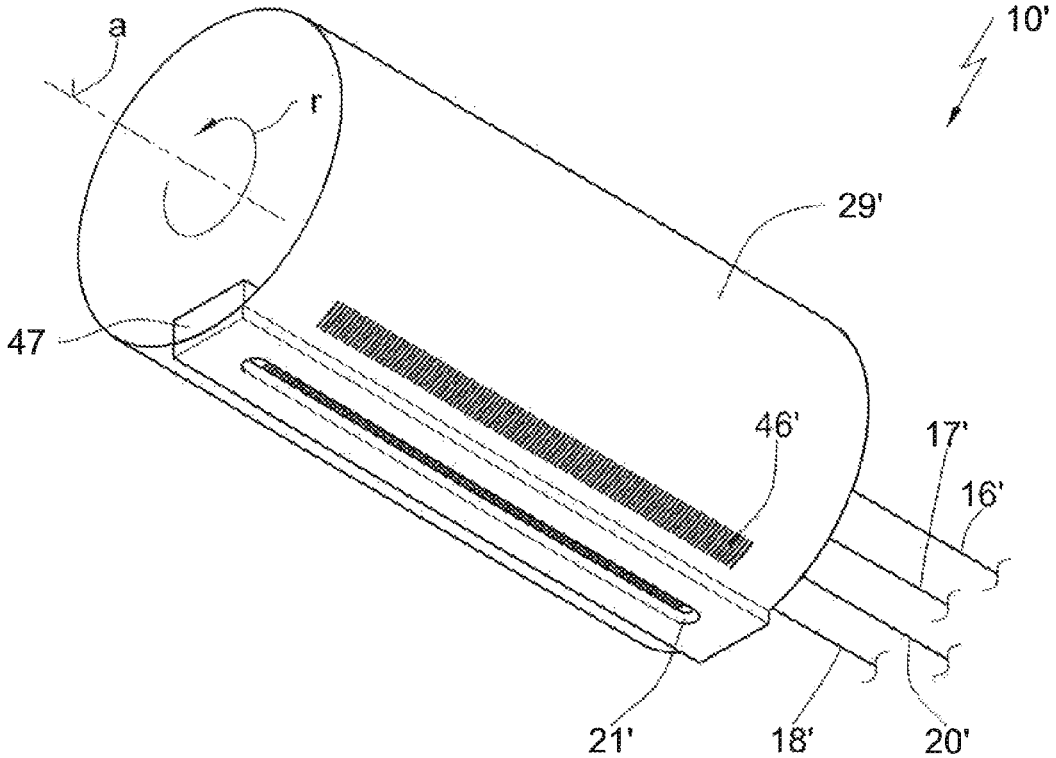
FIG. 8 shows a second embodiment in a highly schematic perspective obliquely illustrated bottom view.

Finally, FIG. 8 shows a second exemplary embodiment of an apparatus 10' according to the invention. The template 29' here is designed, in a rotationally symmetrical manner about a pivot axis a, in the form of a cylinder surface or cylinder tube 29', which rotates about the longitudinal axis a along the direction of rotation r. In the same way as for the exemplary embodiment of FIGS. 1 to 7, the individual exit openings of the individual patterns 46' in the template 29' here are likewise guided past an exit opening 21', which is arranged in a central body 47.

On its side assigned to the inside of the template 29', as is indicated merely schematically in FIG. 8, the central body 47 has connections 16', 17', 18' and 20' for compressed air, power and adhesive and also has an adhesive outflow. The construction of the central body 47 here may be essentially identical to the construction of the application head 11 belonging to the apparatus 10 according to FIGS. 1 to 7.

In particular, the central body 47 has a cross section which corresponds essentially to FIG. 5. Accordingly, alongside the exit opening 21' illustrated in FIG. 8, the central body 47 of course also contains within it an outflow opening for the adhesive and a fluid opening for providing an air knife, by means of which the adhesive (which is transported from the transfer opening to the fluid opening along the direction of rotation r) is then transferred, via the exit opening 21', onto the substrate, which is arranged beneath the central body 47, but is not illustrated in FIG. 8.

FIG. 8 essentially makes clear the fact that the template need not be designed in the form of a disk. Rather, it may also be designed in tubular form. However, a rotary body is always advantageous, be this in the form of a disk 29 or in the form of a cylinder tube 29', since this allows a rotary operation which can guide the cavities endlessly past the exit opening.

The invention claimed is:

1. An apparatus for applying a liquid to pasty hot-melt adhesive to a substrate, comprising:

a template, having at least one cavity for the hot-melt adhesive, the template having a first side and a second side opposite to the first side;

an adhesive-transfer infeed cooperating with the template and through which the adhesive is introduced into the at least one cavity from the first side;

a transporting-fluid-supply opening cooperating with the template;

a device for displacing the template between a first position, in which the at least one cavity is assigned to the adhesive-transfer infeed, and a second position, in which the at least one cavity is assigned to the transporting-fluid-supply opening, wherein the adhesive, in the second position, is discharged from the at least one cavity at the second side of the template by a transporting fluid flowing through the transporting-fluid-supply opening.

2. The apparatus of claim 1 including a stationary exit opening in communication with the at least one cavity when the template is in the second position, the stationary exit opening positioned opposite the transporting-fluid-supply opening relative to the template.

3. The apparatus of claim 1 including an outflow channel, an inlet of the outflow channel cooperating with the at least one cavity when the template is in the first position, the inlet being arranged opposing the adhesive-transfer infeed relative to the template.

4. The apparatus of claim 1 including sealing walls between the adhesive-transfer infeed and the transporting-fluid-supply positioned on either side of the template.

5. The apparatus of claim 1, wherein the template is operably connected to the displacement device for rotating the template and wherein with each full revolution of the template, the at least one cavity passes by the adhesive-transfer infeed once and the transporting-fluid-supply opening once.

6. The apparatus of claim 1, wherein the template is in the form of an disk having a diameter between 5 and 20 cm.

7. The apparatus of claim 6, wherein the disk has a diameter between 7 and 14 cm.

8. The apparatus of claim 7, wherein the disk has a diameter of about 12 cm.

9. The apparatus of claim 1, wherein the template has a positioning marker and wherein the apparatus has a counter-marker, and wherein alignment of the counter-marker and positioning marker permits initial positioning of the template in the apparatus.

10. The apparatus of claim 1, wherein the apparatus has an opening mechanism for removably replacing the template with an alternative template without the use of tools.

11. The apparatus of claim 1, wherein the at least one cavity has a width of less than or equal to 2 mm.

12. The apparatus of claim 11, wherein the at least one cavity has a width of less than or equal to 1 mm.

13. The apparatus of claim 1, wherein the template includes multiple cavities, the multiple cavities being arranged in a pattern.

14. The apparatus of claim 1 including an air knife for discharging the adhesive from the cavity.

15. An apparatus for applying a liquid to pasty hot-melt adhesive to a substrate, comprising:

a template, having at least one cavity for the hot-melt adhesive;

an adhesive-transfer infeed cooperating with the template and through which the adhesive is introduced into the at least one cavity;

a transporting-fluid-supply opening cooperating with the template; and a device for displacing the template between a first position, in which the at least one cavity is assigned to the adhesive-transfer infeed, and a second position, in which the at least one cavity is assigned to the transporting-fluid-supply opening, wherein the adhesive, in the second position, is discharged from the at least one cavity by a transporting fluid flowing through the transporting-fluid-supply opening, and wherein the template is in the form of an disk having a diameter between 5 and 20 cm.

16. An apparatus for applying a hot-melt adhesive to a substrate, comprising:

a template, having at least one cavity for the hot-melt adhesive;

an adhesive-transfer infeed cooperating with the template and through which the adhesive is introduced into the at least one cavity;

a transporting-fluid-supply opening cooperating with the template;

a device for displacing the template between a first position, in which the at least one cavity is assigned to the adhesive-transfer infeed, and a second position, in which the at least one cavity is assigned to the transporting-fluid-supply opening;

an outflow channel downstream from the template, an inlet of the outflow channel cooperating with the at least one cavity when the template is in the first position, the inlet being arranged opposing the adhesive-transfer infeed relative to the template;

a stationary exit opening downstream from the template in communication with the at least one cavity when the template is in the second position, the stationary exit opening positioned opposite the transporting-fluid-supply opening relative to the template, and wherein the adhesive, in the second position, is discharged from the at least one cavity by a transporting fluid flowing through the transporting-fluid-supply opening.

* * * * *